United States Patent [19]

Thuillier et al.

[11] 4,063,934

[45] Dec. 20, 1977

[54] HEAT RESISTING NICKEL-CHROMIUM ALLOY HAVING HIGH RESISTANCE TO OXIDATION, CARBURIZATION AND CREEP AT HIGH TEMPERATURES

[75] Inventors: Jacques Thuillier, Pont de l'Arche; Michel Hugo, Custines, both of France

[73] Assignee: Acieries du Manoir Pompey, Neuilly-sur-Seine, France

[21] Appl. No.: 660,861

[22] Filed: Feb. 24, 1976

[30] Foreign Application Priority Data

Dec. 2, 1975 France ..... 75.36877

[51] Int. Cl.[2] ..... C22C 30/00; C22C 19/05

[52] U.S. Cl. ..... 75/122; 75/134 C; 75/134 F; 75/171

[58] Field of Search ..... 75/134 F, 134 C, 122, 75/171

[56] References Cited

U.S. PATENT DOCUMENTS

| | | | |
|---|---|---|---|
| 3,627,516 | 12/1971 | Bellot et al. | 75/128 G |
| 3,758,294 | 9/1973 | Bellot et al. | 75/134 F |
| 3,759,704 | 9/1973 | Culling | 75/122 |
| 3,833,358 | 9/1974 | Bellot et al. | 75/122 |
| 3,893,851 | 7/1975 | Culling | 75/171 |
| 3,900,316 | 8/1975 | Jones | 75/128 A |

FOREIGN PATENT DOCUMENTS

| | | | |
|---|---|---|---|
| 2,135,179 | 2/1972 | Germany | 25/122 |

*Primary Examiner*—Arthur J. Steiner
*Attorney, Agent, or Firm*—Kenyon & Kenyon, Reilly, Carr & Chapin

[57] ABSTRACT

The heat resisting alloy of the invention has a high resistance to oxidation, carburization and creep at very high temperatures; its composition is as follows (in % by weight):

| | |
|---|---|
| Ni | 24 - 53 |
| Cr | 20 - 44 |
| C | 0.01 - 0.6 |
| Mn | 0.1 - 1.5 |
| Si | 1.3 - 3 |
| Nb | 0.5 - 3 |
| N | 0.05 - 0.2 |
| (W + Mo) | 0.2 - 5 |
| Fe | 0 - 47 |
| Cu | 0 - 5 |

the minimum copper content in case the alloy contains tungsten and less than 40% nickel is at least 0.1%; the Ni/Cr ratio is between 1.20 and 1.40.

15 Claims, 3 Drawing Figures

Figure 1:
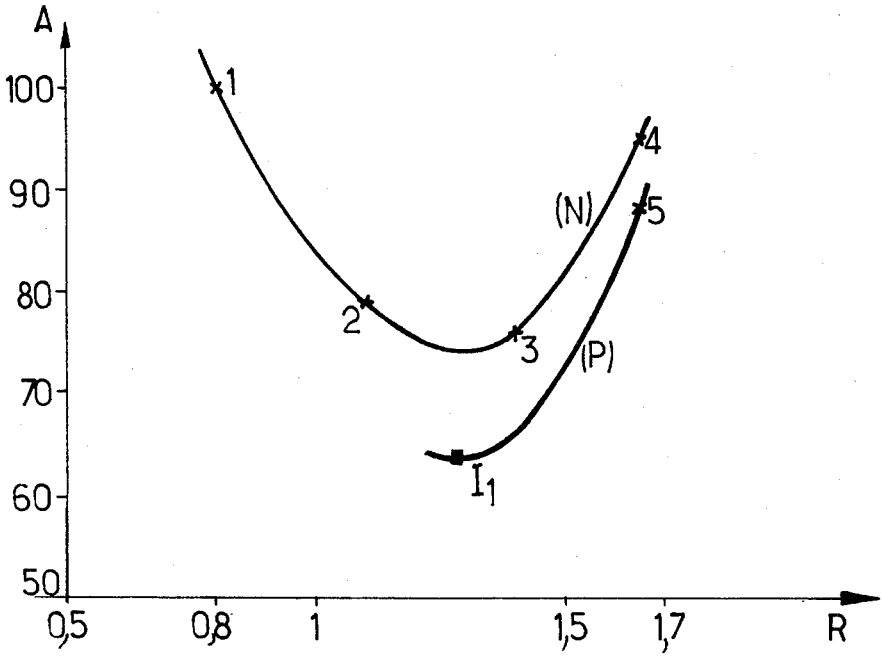

HEAT RESISTING NICKEL-CHROMIUM ALLOY HAVING HIGH RESISTANCE TO OXIDATION, CARBURIZATION AND CREEP AT HIGH TEMPERATURES

The present invention relates to a heat resisting alloy, essentially a heat resisting alloy based on nickel and chromium, and possibly on iron, offering high oxidation, carburization and/or creep resistance up to very high temperatures.

The present invention also relates to any article, part or member made from the said heat resisting alloy.

The heat resisting alloys according to the present invention are more particularly suitable for the manufacture of structural elements used in plants intended for high-temperature processes in oxidizing and/or carburizing media, such as pipes in certain petrochemical processing plants.

The life of the pipes, usually in the form of centrifuged or rolled pipes, in such plants is directly related to the oxidation resistance or the carburization resistance of the alloys used.

The alloy in most current use hitherto contains 20% nickel, 25% chromium, 1% manganese and 1% silicon, with 0.4% carbon, the balance being iron or the usual impurities. The resistance to carburization of such an alloy is, however, definitely unsatisfactory at temperatures exceeding 1000° C.

It has also been found that an increase of the silicon and nickel contents as well as the addition of elements such as tungsten and/or niobium have a favorable effect upon oxidation resistance and/or carburization resistance.

However, the known alloys to which the above remarks apply are difficult to use at temperatures higher than 1000° C for a very long working time owing to insufficient resistance to carburization.

The present invention allows the above drawbacks to be remedied, since it provides an alloy which has a better resistance to carburization at any temperature and therefore a longer working life;

is apt to be used with a definitely improved life at temperatures higher than 1000° C, which may reach 1100° C or more.

The alloy according to the present invention is of the type described previously including nickel, chromium, carbon, manganese, silicon, as well as niobium, nitrogen and possibly iron and tungsten.

The heat resisting alloy according to the present invention, having high oxidation, carburization and creep resistance at very high temperatures, is characterized by the following composition (% by weight):

| | |
|---|---|
| Ni | 24 - 53 |
| Cr | 20 - 44 |
| C | 0.01 - 0.6 |
| Mn | 0.1 - 1.5 |
| Si | 1.3 - 3 |
| Nb | 0.5 - 3 |
| N | 0.05 - 0.2 |
| (W + Mo) | 0.2 - 5 |
| Fe | 0 - 47 |
| Cu | 0 - 5 |

the Ni/Cr weight ratio being comprised between 1.20 and 1.40, and the minimum copper content, in an alloy containing tungsten and less than 40% nickel, being at least 0.1% and preferably at least 0.5%.

The alloy having the above-described composition displays remarkably improved resistance to carburization at 1100° C or more, and its life is therefore considerably increased: indeed, an improvement of the order of 25% of the resistance to carburization (expressed by the indices defined hereinafter) permits of doubling or even trebling the life of the articles, parts or members according to the invention, subjected to processes at temperatures as high as 1100° C.

More particularly, the judicious choice of the above-mentioned nickel/chromium ratio seems to be the main factor in the striking improvement in the carburization resistance of the alloys of the invention as compared with the known alloys.

Moreover, even a small addition of copper is apt to additionally and substantially increase the carburization resistance and creep resistance of the alloys considered.

Preferably, the amounts of the aforementioned elements in the alloys of the present invention are comprised, individually or simultaneously, within the following reduced ranges:

| | |
|---|---|
| Cu | 0.5 - 5 % by weight |
| C | 0.4 - 0.6 % by weight |
| (W + Mo) | 1 - 5 % by weight |
| Nb | 1 - 2 % by weight |

On the other hand, the total amount of carburigenic or carbon-enriching elements other than chromium, such as tungsten, niobium, molybdenum or others, preferably does not exceed 10% by weight.

Furthermore, according to a preferred form of embodiment of the present invention, the nickel content of the alloy is higher than 40% and preferably higher than or equal to 45%.

Figure 2:
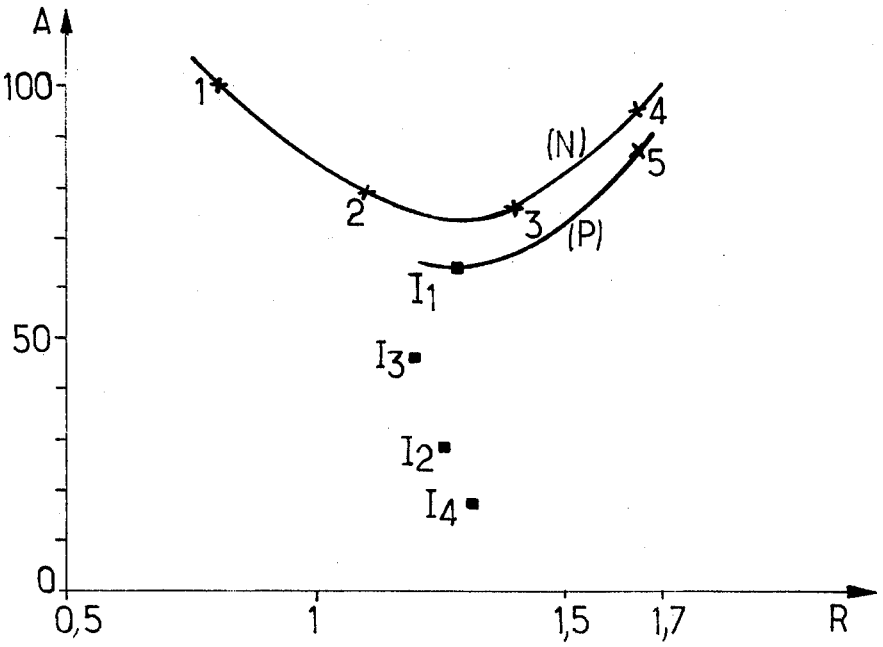

The invention will be better understood and other purposes, features, details and advantages thereof will appear more clearly from the following explanatory description made with reference to the appended drawings illustrating the favourable properties of various alloys according to the invention given solely by way of non-limitative examples, wherein:

FIGS. 1 and 2 are graphic representations relating to various alloys and showing the variations of an index A as a function of R, the index A representing the aptitude of the alloys considered to carburization, R being the Ni/Cr ratio, to two different scales: among these alloys, the alloy $I_1$ is the only one complying with the present invention.

The graph in FIG. 2, to a smaller scale than that of FIG. 1, contains more points representing the alloys of the present invention ($I_1$ to $I_4$).

Figure 3:
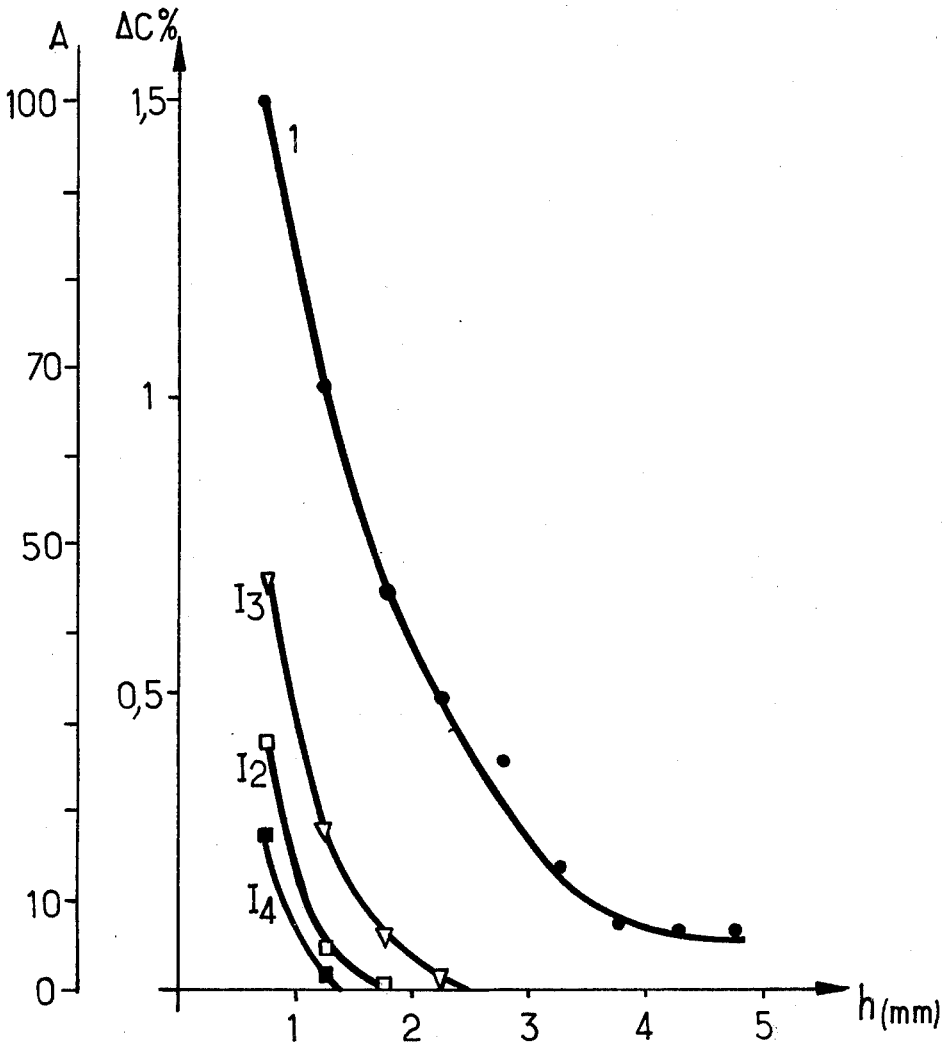

FIG. 3 is a graphic representation relating to various alloys including the alloys $I_2$, $I_3$ and $I_4$ of the invention, and showing the variations of the enrichment of the carbon percentage $\Delta C\%$ as a function of the depth $h$ (in mm) from the surface of the alloy.

In the first place, FIG. 1 illustrates the variation of the carburization resistance of the various tested alloys with increasing nickel contents and a substantially constant chromium content on the order of 25 to 27% by weight.

The alloys considered comprise the alloys 1 to 4 in the following Table 1.

Table 1

| Alloy No. | Ni | Cr | Nb | W | Mo | Cu | C | Mn | Si | N | Fe and impurities | R+ | A* |
|---|---|---|---|---|---|---|---|---|---|---|---|---|---|
| 1 | 20 | 25 | — | — | — | — | 0.4 | 1 | 1.3 | 0.08 | 52.31 | 0.80 | 10 |
| 2 | 30 | 27 | — | — | — | — | 0.4 | 1 | 1.3 | 0.08 | 40.22 | 1.10 | 7 |
| 3 | 35 | 25 | — | — | — | — | 0.4 | 1 | 1.3 | 0.08 | 37.22 | 1.40 | 7 |
| 4 | 43 | 26 | — | — | — | — | 0.4 | 1 | 1.3 | 0.08 | 28.22 | 1.65 | 9 |

*index A: carbon percentage enrichment between 0.5 and 1 mm depth after carburization during 100 hr at 1100° C (index A conventionally equal to 100 for alloy 1 with 20 % nickel and 25 % chromium) in a tube with an inner diameter of 100 mm and a length of 0.796 m.
R+ : Ni/Cr weight ratio.

The curve (N) connecting the points representing these alloys shows that there is a range of nickel and chromium concentration where the resistance to carburization is optimum. More particularly, it shows a remarkable and unexpected improvement of resistance to carburization when the ratio R is comprised between 1.20 and 1.40. Below and above these values there is a relatively abrupt reduction of the said resistance.

Thus, for all the alloys of the present invention, the favourable ratio R will be comprised between 1.20 and 1.40.

On the other hand, the addition of niobium plus tungsten or niobium plus molybdenum also substantially improves the carburization resistance and the creep resistance of this type of alloy.

This improvement is obvious from the curve (P) illustrated in FIGS. 1 and 2.

The compositions of the alloys $I_1$ and 5 constituting the representative points on this curve are indicated in the following Table 2 together with those of alloys 1 and 4.

Table 2

| Alloy No | Ni | Cr | Nb | W | Mo | Cu | C | Mn | Si | N | Fe and impurities | R | A |
|---|---|---|---|---|---|---|---|---|---|---|---|---|---|
| 1 | 20 | 25 | — | — | — | — | 0.4 | 1 | 1.3 | 0.08 | 52.22 | 0.80 | 100 |
| $I_1$ | 32 | 25 | 1 | — | 1.6 | — | 0.4 | 0.7 | 1.5 | 0.1 | 37.7 | 1.28 | 64 |
| 5 | 43 | 26 | 1 | 1.6 | — | — | 0.03 | 1.5 | 2 | 0.15 | 24.72 | 1.65 | 88 |
| 4 | 43 | 26 | — | — | — | — | 0.4 | 1 | 1.3 | 0.08 | 28.22 | 1.65 | 95 |

wherein R and A have the aforementioned meanings.

From a comparison between the curves (N) and (P) and, for example, of the points representing on these curves the alloys 4 and 5, respectively, it clearly appears that there is a reduction of the carburization index A of alloys with equal nickel and chromium contents containing also niobium as well as tungsten and/or molybdenum.

Although this addition of two further elements substantially improves the carburization resistance, the favourable nickel/chromium ratio is the predominant factor.

Thus, the alloy $I_1$ is the first example of alloy illustrating the present invention.

Further, the improvement provided by a simultaneous increase in the nickel and chromium contents while keeping a Ni/Cr ratio of the same order of magnitude in the presence of niobium and tungsten and/or molybdenum is disclosed by a study of the following Table with reference to FIG. 2.

Table 3

| Alloy No | Ni | Cr | Nb | W | Mo | Cu | C | Mn | Si | N | Fe and impurities | R | A |
|---|---|---|---|---|---|---|---|---|---|---|---|---|---|
| 1 | 20 | 25 | — | — | — | — | 0.4 | 1 | 1.3 | 0.08 | 52.22 | 0.80 | 100 |
| 5 | 43 | 26 | 1 | 1.6 | — | — | 0.03 | 1.5 | 2 | 0.15 | 24.72 | 1.65 | 88 |
| $I_2$ | 44 | 35 | 1.2 | 1.4 | — | — | 0.6 | 0.8 | 1.7 | 0.12 | 15.18 | 1.26 | 28 |
| $I_1$ | 32 | 25 | 1 | — | 1.6 | — | 0.4 | 0.7 | 1.5 | 0.1 | 37.7 | 1.28 | 64 |

wherein R and A have the aforementioned meanings.

By comparing alloy $I_1$ and alloy $I_2$ it is seen that there is a substantial improvement of the carburization resistance, with equally favourable ratios R, of the alloys of the invention with high nickel and chromium contents, which are the preferred alloys of the present invention.

On the other hand, a comparison between alloy 5 and alloy $I_2$ (according to the invention) shows as improvement of the carburization resistance on the order of 68% provided by the appropriate Ni/Cr ratio of the present invention.

Furthermore, a small addition of copper, while maintaining the Ni/Cr ratio at about 1.20 to 1.40, additionally increases the carburization resistance of the alloys considered. This additional improvement can also be observed by referring to the following Table 4 and to FIG. 2 and by comparing the alloys $I_1$ and $I_3$, on the one hand, with the alloys $I_2$ and $I_4$, on the other hand.

TABLE 4

| | Ni | Cr | Nb | W | Mo | Cu | C | Mn | Si | N | Fe and impurities | R | A | B** |
|---|---|---|---|---|---|---|---|---|---|---|---|---|---|---|
| 1 | 20 | 25 | — | — | — | — | 0.4 | 1 | 1.3 | 0.08 | 52.22 | 0.80 | 100 | 100 |
| $I_1$ | 32 | 25 | 1 | — | 1.6 | — | 0.4 | 0.7 | 1.5 | 0.1 | 37.7 | 1.28 | 64 | 50 |
| $I_3$ | 32.5 | 27 | 1.1 | 1.4 | — | 1.6 | 0.6 | 0.6 | 1.6 | 0.09 | 33.5 | 1.20 | 46 | 29 |
| $I_2$ | 44 | 35 | 1.2 | 1.4 | — | — | 0.6 | 0.8 | 1.7 | 0.12 | 15.18 | 1.26 | 28 | 15 |

TABLE 4-continued

| | Ni | Cr | Nb | W | Mo | Cu | C | Mn | Si | N | Fe and impurities | R | A | B** |
|---|---|---|---|---|---|---|---|---|---|---|---|---|---|---|
| $I_4$ | 44.6 | 34 | 1.1 | 1.6 | — | 1.7 | 0.6 | 0.8 | 1.5 | 0.1 | 14 | 1.31 | 17 | 9.5 |

B** = representative index of carburization resistance, indicating the carbon weight absorbed by a tube with an inner diameter of 100 mm and a length of 0.796 m after carburization during 100 hrs at 1100° C (under the same conditions as in test A).
R and A have the aforementioned meanings.

Thus, within the field of the steels of the invention itself, the favourable influence of an addition of copper is clearly shown by the significant reduction of the A and B indices of these preferred alloys.

In FIG. 3, three alloys $I_2$, $I_3$ and $I_4$ are more thoroughly compared with the reference alloy 1.

Considering the curve illustrating the enrichment in carbon percentage $\Delta C\%$ of the alloy 1 as a function of the distance *h* to the surface of the said alloy, it is seen that this carbon percentage increases, in a carburization test, to depths of the order of 5 mm.

On the contrary, for the alloys of the present invention, the carburization is not perceptible to depths exceeding 2.5 mm (alloys $I_2$ to $I_4$) and even, in some cases, 1.5 mm (copper-based alloy $I_4$), which is a considerable improvement of the alloys of the present invention as compared with the known alloys.

It is noted that, for each curve, the ordinate of the maximum point corresponding to the carbon percentage between 0.5 and 1 mm depth subsequent to carburization, easily gives the value of the index A: the value of 100 has been given to such a carbon percentage of the reference alloy 1.

In another respect, a simple calculation shows that the index B is proportional to the value obtained by integrating the surfaces located below each curve.

As additional examples of alloys according to the invention, the following particular compositions of such alloys can be mentioned:

| | |
|---|---|
| manganese | about 0.8 % |
| carbon | about 0.4 % |
| silicon | about 1.5 % |
| niobium | about 1.2 % |
| tungsten | about 1.6 % |
| nitrogen | about 0.1 % |
| copper | about 1.6 % |

the respective nickel and chromium contents being comprised between the above-mentioned general ranges, with an Ni/Cr ratio of about 1.3.

The compositions of two other alloys $I_5$ and $I_6$ according to the invention are mentioned hereinafter in order to more completely illustrate the series of alloys according to the present invention.

Table 5

| Alloy No | Ni | Cr | Nb | W | Mo | Cu | C | Mn | Si | N | Fe and impurities | R |
|---|---|---|---|---|---|---|---|---|---|---|---|---|
| $I_5$ | 50.7 | 37 | 1.3 | 0.2 | 0.2 | 4.5 | 0.2 | 0.7 | 1.3 | 0.2 | 3.7 | 1.37 |
| $I_6$ | 29 | 22 | 2 | 1.5 | 3 | 0.55 | 0.02 | 1.3 | 2 | 0.1 | 38.53 | 1.32 |

Furthermore the applicant considers that the alloys according to the present invention can be presently classified, for practical reasons, into the following four classes, depending upon their nickel content:

25 to 33% Ni by weight, preferably with copper
33 to 36% Ni by weight
40 to 45% Ni by weight
45 to 53% Ni by weight.

Of course, the present invention is by no means limited to the forms of embodiment described and illustrated, which have been given by way of example only. In particular, it comprises all the means constituting technical equivalents to the means described as well as their combinations, should the latter be performed according to its spirit and carried out within the following claims.

What is claimed is:

1. Heat resisting alloy having a high resistance to oxidation, carburization and creep at very high temperatures and consisting essentially of the following elements in the following by-weight proportion ranges:

| | | |
|---|---|---|
| Ni | 24 - 53 | % |
| Cr | 20 - 44 | % |
| C | 0.01 - 0.6 | % |
| Mn | 0.1 - 1.5 | % |
| Si | 1.3 - 3 | % |
| Nb | 0.5 - 3 | % |
| N | 0.05 - 0.2 | % |
| (W + Mo) | 0.2 - 5 | % |
| Fe | 0 - 47 | % |
| Cu | 0.1 - 5 | % |

the Ni/Cr by-weight ratio being between 1.20 and 1.40.

2. Alloy according to claim 1, wherein the carbon content is between 0.4 and 0.6% by weight.

3. Alloy according to claim 1, wherein the sum of the tungsten and molybdenum contents is between 1 and 5% by weight.

4. Alloy according to claim 1, wherein the niobium content is between 1 and 2% by weight.

5. Alloy according to claim 1, wherein its nickel content is higher than 40% by weight.

6. Alloy according to claim 1, wherein its nickel content is at least 45% by weight.

7. Alloy according to claim 1, characterized in that it consists essentially of the following composition (% by weight):

| | |
|---|---|
| Ni | about 32.5 |
| Cr | about 27 |
| Nb | about 1.1 |
| W | about 1.4 |
| Cu | about 1.6 |
| C | 0.01 - 0.6 |
| Mn | 0.1 - 1.5 |
| Si | 1.3 - 3 |
| N | 0.05 - 0.2 |

the balance being iron and impurities.

8. Alloy according to claim 1, characterized in that it consists essentially of the following composition (% by weight):

| | |
|---|---|
| Ni | about 44.6 |
| Cr | about 34 |
| Nb | about 1.1 |
| W | about 1.6 |
| Cu | about 1.7 |
| C | 0.01 - 0.6 |
| Mn | 0.1 - 1.5 |
| Si | 1.3 - 3 |
| N | 0.05 - 0.2 |

the balance being iron and impurities.

9. Alloy according to claim 1, characterized in that it consists essentially of the following composition (% by weight):

| | |
|---|---|
| Ni | about 50.7 |
| Cr | about 37 |
| Cu | about 4.5 |
| W | about 0.2 |
| Mo | about 0.2 |
| Nb | about 1.3 |
| C | 0.01 - 0.6 |
| Mn | 0.1 - 1.5 |
| Si | 1.3 - 3 |
| N | 0.05 - 0.2 |

the balance being iron and impurities.

10. Alloy according to claim 1, characterized in that it consists essentially of the following composition (% by weight):

| | |
|---|---|
| Ni | about 29 |
| Cr | about 22 |
| Cu | about 0.55 |
| W | about 1.5 |
| Mo | about 3 |
| Nb | about 2 |
| C | 0.01 - 0.6 |
| Mn | 0.1 - 1.5 |
| Si | 1.3 - 3 |
| N | 0.05 - 0.2 |

the balance being iron and impurities.

11. Heat-resisting alloy having a high resistance to oxidation, carburization and creep at very high temperatures and consisting essentially of the following elements in the following by-weight proportion ranges:

| | | | | |
|---|---|---|---|---|
| Ni | 40 | - | 53 | % |
| Cr | 28.6 | - | 44 | % |
| C | 0.01 | - | 0.6 | % |
| Mn | 0.1 | - | 1.5 | % |
| Si | 1.3 | - | 3 | % |
| Nb | 0.5 | - | 3 | % |
| N | 0.05 | - | 0.2 | % |

-continued

| | | | | |
|---|---|---|---|---|
| (W + Mo) | 0.2 | - | 5 | % |
| Fe | 0 | - | 47 | % |
| Cu | 0 | - | 5 | % |

the Ni/Cr by-weight ratio being between 1.20 and 1.40.

12. Alloy according to claim 1, characterized in that it consists essentially of the following composition (% by weight):

| | |
|---|---|
| Ni | about 44 |
| Cr | about 35 |
| Nb | about 1.2 |
| W | about 1.4 |
| C | 0.01 - 0.6 |
| Mn | 0.1 - 1.5 |
| Si | 1.3 - 3 |
| N | 0.05 - 0.2 |

the balance being iron and impurities.

13. Heat resisting alloy having a high resistance to oxidation, carburization and creep at very high temperatures and consisting essentially of the following elements in the following by-weight proportion ranges:

| | | | | |
|---|---|---|---|---|
| Ni | 40 | - | 53 | % |
| Cr | 28.6 | - | 44 | % |
| C | 0.01 | - | 0.6 | % |
| Mn | 0.1 | - | 1.5 | % |
| Si | 1.3 | - | 3 | % |
| Nb | 0.5 | - | 3 | % |
| N | 0.05 | - | 0.2 | % |
| (W + Mo) | 0.2 | - | 5 | % |
| Fe | 0 | - | 47 | % |
| Cu | 0.5 | - | 5 | % |

the Ni/Cr by-weight ratio being between 1.20 and 1.40.

14. Heat resistant alloy according to claim 1, wherein the by-weight copper proportion range is 0.5 - 5%.

15. Heat-resistant alloy having a high resistance to oxidation, carburization and creep at very high temperatures and consisting essentially of the following elements in the following by-weight proportion ranges:

| | | | | |
|---|---|---|---|---|
| Ni | 40 | - | 53 | % |
| Cr | 28.6 | - | 44 | % |
| C | 0.4 | - | 0.6 | % |
| Si | 1.3 | - | 3 | % |
| Nb | 0.5 | - | 3 | % |
| N | 0.05 | - | 0.2 | % |
| (W + Mo) | 0.2 | - | 5 | % |
| Fe | 0 | - | 47 | % |
| Cu | 0 | - | 5 | % |
| Mn | 0.1 | - | 1.5 | % |

the Ni/Cr by-weight ratio being between 1.20 and 1.40.

* * * * *

UNITED STATES PATENT AND TRADEMARK OFFICE

CERTIFICATE OF CORRECTION

PATENT NO. : 4,063,934

DATED : December 20, 1977

INVENTOR(S) : Jacques Thuillier et al.

It is certified that error appears in the above-identified patent and that said Letters Patent are hereby corrected as shown below:

In Table 1, under column heading A,

Change "10" to --100--;

Change "7" to --79--;

Change "7" to --76--; and

Change "9" to --95--.

Signed and Sealed this

Fourth Day of April 1978

[SEAL]

Attest:

RUTH C. MASON
Attesting Officer

LUTRELLE F. PARKER
Acting Commissioner of Patents and Trademarks